United States Patent [19]

Portz et al.

[11] 3,948,519

[45] Apr. 6, 1976

[54] HANDGRIP FOR GAME RACKET

[75] Inventors: William E. Portz, Geneva; John T. Kanne, Ashtabular, both of Ohio

[73] Assignee: True Temper Corporation, Cleveland, Ohio

[22] Filed: Nov. 15, 1974

[21] Appl. No.: 523,992

Related U.S. Application Data

[62] Division of Ser. No. 294,825, Oct. 4, 1972, Pat. No. 3,879,036.

[52] U.S. Cl. ..... 273/73 J

[51] Int. Cl.[2] ..... A63B 49/08

[58] Field of Search.... 273/73 R, 73 D, 73 G, 73 H, 273/73 J, 75, 67 DA, 73 C

[56] References Cited

UNITED STATES PATENTS

| | | | |
|---|---|---|---|
| 1,452,803 | 4/1923 | Harris | 273/73 H |
| 1,524,826 | 2/1925 | Icke et al. | 273/73 H |
| 1,562,881 | 11/1925 | Gower et al. | 273/73 H |
| 1,587,918 | 6/1926 | Morrison | 273/73 J X |
| 1,588,139 | 6/1926 | Penney | 273/73 H |
| 2,171,223 | 8/1939 | Robinson | 273/73 H |
| 3,529,826 | 9/1970 | Hulyk | 273/73 J UX |
| 3,540,728 | 11/1970 | Palmer | 273/73 J |
| 3,547,440 | 12/1970 | Deer | 273/73 J X |
| 3,582,072 | 6/1971 | Stueck | 273/73 J |
| 3,582,073 | 6/1971 | Melnick et al. | 273/73 J X |
| 3,612,526 | 10/1971 | Brull | 273/73 J X |
| 3,642,283 | 2/1972 | Wilkens | 273/73 H X |
| 3,664,669 | 5/1972 | Latham et al. | 273/73 J |
| 3,674,267 | 7/1972 | Hollis | 273/73 J X |

FOREIGN PATENTS OR APPLICATIONS

| | | | |
|---|---|---|---|
| 2,000,606 | 9/1969 | France | 273/73 H |
| 974,039 | 9/1950 | France | 273/73 J |
| 522,222 | 6/1940 | United Kingdom | 273/73 J |

*Primary Examiner*—Richard J. Apley

[57] ABSTRACT

There is disclosed herein a game racket having a frame formed from a single length of tubular framing shaped into an oval and having parallel extensions for the handle. The extensions are provided with connectors which space the extensions a fixed distance apart and provide interlocking means for securing the extensions to each other. Handgrip means in the form of two complementary sections encase distal end portions of the extensions and the connectors to provide a grip for the racket.

3 Claims, 13 Drawing Figures

HANDGRIP FOR GAME RACKET

This is a division of application Ser. No. 294,825, filed Oct. 4, 1972, now U.S. Pat. No. 3,879,036, dated Apr. 22, 1975.

This invention relates to game rackets and particularly to a handgrip structure therefor.

Game rackets of the type having a striking portion comprising a loop crisscrossed with taut strings are commonly formed from an elongated strip of framing material bent to provide the loop and having converging portions and parallel portions extending from one end of the loop to provide a throat and a handle, respectively. The present invention is directed to improved means for encasing the parallel extension portions of a racket whereby a solid, unitary, durable, and comfortable handgrip is provided.

A primary object of the invention is to provide an improved handgrip or handle structure for game rackets of the type wherein the handle comprises a pair of parallel members extending from the loop.

Another object of the invention is to provide a handgrip including means positively spacing the parallel members laterally a predetermined distance.

Still another object of the invention is to provide a handgrip as set forth above wherein the lower end portions of the parallel members are completely encased by sections of the handgrip.

Yet another object of the invention is to provide a handgrip adapted for use on parallel members having a longitudinal groove therein opening either inwardly or outwardly with respect to the racket handle.

A still further object of the invention is to provide a handgrip as set forth above particularly adapted for use with parallel members of tubular metallic construction.

Other objects of the invention and the invention itself will be apparent from the following description thereof and the accompanying drawings, in which said drawings.

Figure 1:
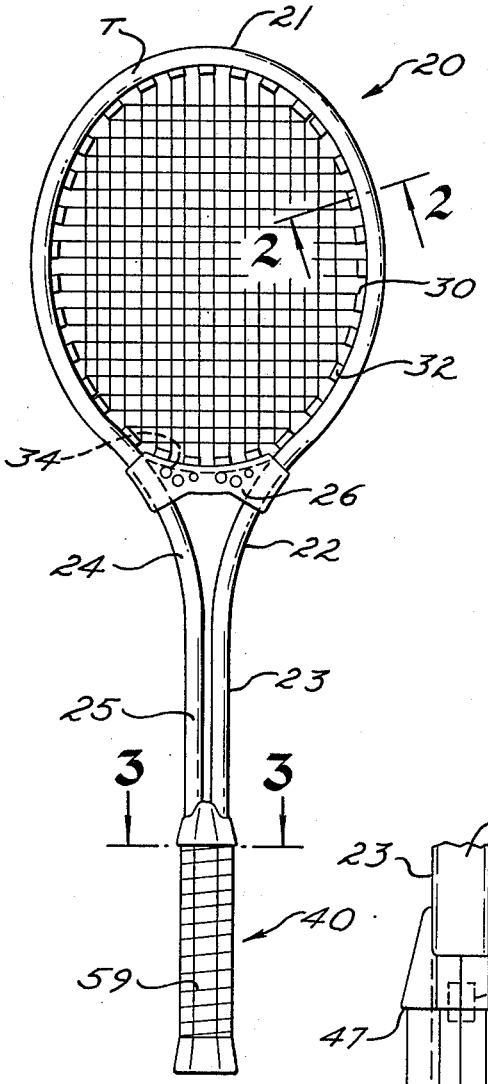
FIG. 1 is a front elevation of a tennis racket embodying the handgrip of this invention.

Referring now to the drawings in all of which like parts are designated by like reference characters, the handgrip of the present invention is embodied in a tennis racket 20 having a conventional loop 21, throat 22, and handle 23. As herein disclosed, the loop, throat, and handle are preferably formed from a single elongated frame member whereby the throat 22 is defined by convergent portions 24 and the handle 23 is defined by parallel, spaced extensions 25 of said elongated member. The frame member illustrated comprises a single length of lightweight metallic tubing T, such as aluminum tubing, but it will be understood that other materials may be used. Also, the loop 21 may be separately formed and the throat 22 and handle 23 secured thereto in any suitable manner.

Figure 2:
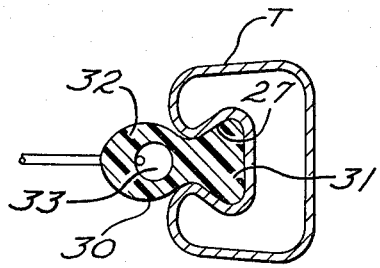
FIG. 2 is a cross section taken along the line 2—2 of FIG. 1 and substantially enlarged with respect thereto.

In the embodiment of the invention herein disclosed the convergent portions 24 are secured together and the loop 21 is completed across the throat 22 by means of a bridge or yoke 26 which may be of any suitable construction. As shown in FIG. 2, the tubing T is generally rectangular in cross section and is so formed as to provide a dovetail shaped groove 27 which opens inwardly of the loop 21 and the extensions 25. String mounting inserts 30 have dovetail shaped bases 31 seated within the dovetail shaped groove 27 whereby said inserts are anchored around the loop 21. Each said insert has a string receiving portion 32 which projects inwardly of the loop 21 and is apertured at 33 to receive strings S laced therethrough. The bridge or yoke 26 preferably is also provided with suitable dovetail shaped groove means, indicated by a dotted line 34, for receiving inserts 30.

Figure 3:
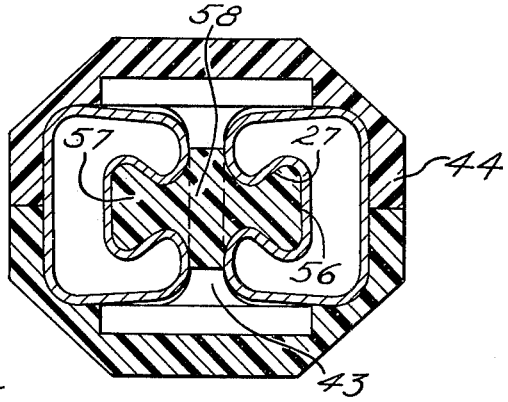
FIG. 3 is a cross section taken along the line 3—3 of FIG. 1 and substantially enlarged with respect thereto.
Figure 5:
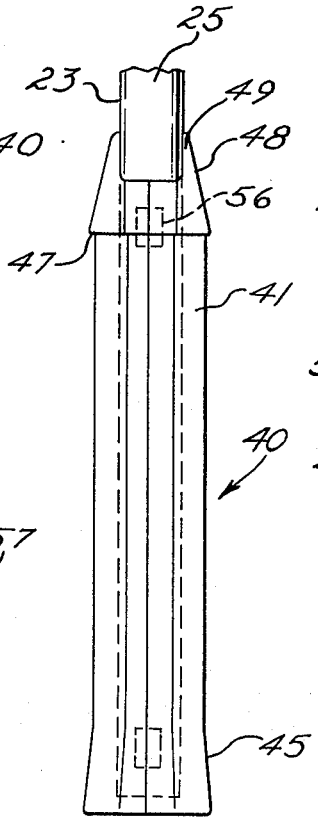
FIG. 5 shows a side view of the handgrip of the racket shown in FIG. 1 somewhat enlarged with respect thereto.
Figure 6:
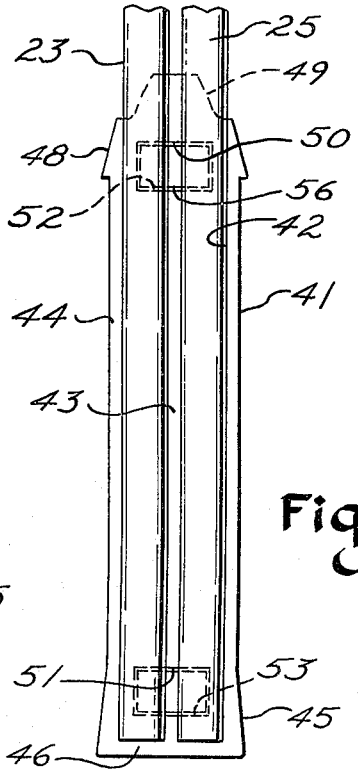
FIG. 6 is a front elevation of the handgrip drawn to the scale of FIG. 5 with one section of the handgrip removed.
Figure 7:
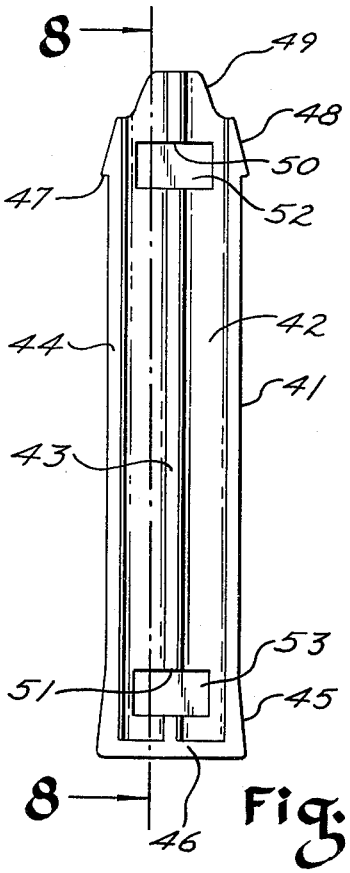
FIG. 7 is an inside elevation of one section of the handgrip drawn to the scale of FIG. 5.

The handgrip of this invention is disposed at the outermost or lowermost end of the handle 23 and is generally indicated at 40 in FIGS. 1 and 5. Said handgrip 40 comprises a pair of complementary sections 41 adapted to fit over the front and back of the handle, each having a pair of elongated recesses 42 for receiving the lower end portions of the extensions 25. As shown in FIG. 3, the extensions 25 nest snugly within the elongated recesses 42 which are spaced apart a slight distance on either side of an inwardly projecting, interposed rib 43. Each section 41 affords half of an octagonal shaped grip, each said section having elongated, parallel side walls 44 adapted to abut edgewise with the side walls 44 of the opposite section 41 whereby the lower end portions of the extension 25 are completely enclosed at the sides as viewed in FIG. 5. The ribs 43 extend substantially the full length of the sections as shown in FIGS. 6 and 7, and the said ribs extend inwardly whereby they substantially meet at a medial plane defined by the edges of the side walls 44. Thus the lower end portions of the extensions 25 are completely encased within the sections 41 of the handgrip 40.

Figure 4:
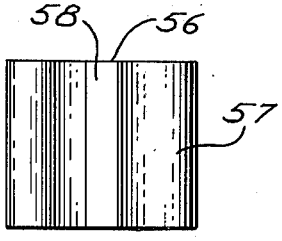
FIG. 4 is a side elevation of a connector member shown in section in FIG. 3.
Figure 8:
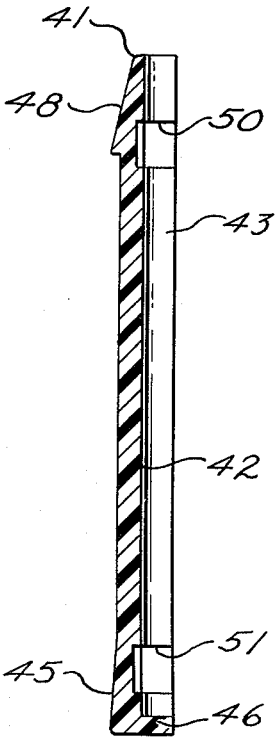
FIG. 8 is a longitudinal section taken along the line 8—8 of FIG. 7.
Figure 11:
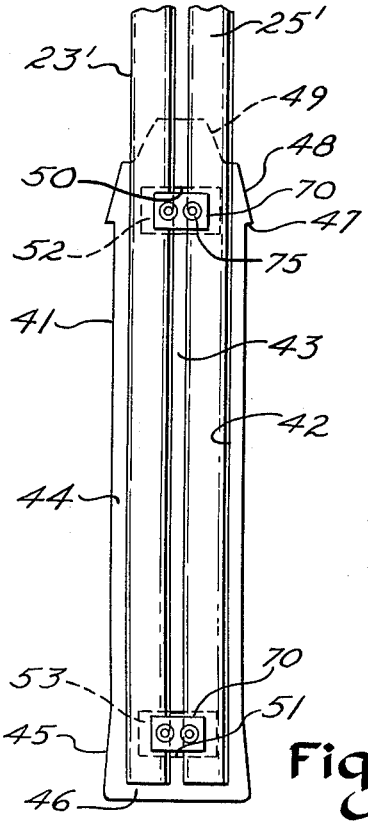
FIG. 11 is a view similar to FIG. 6 showing the modified frame means of FIG. 9.
Figure 12:
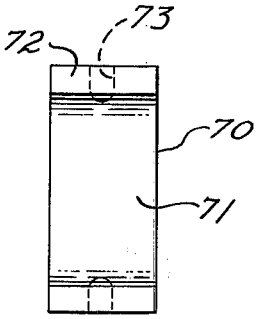
FIG. 12 is a side elevation of a connector member shown in section in FIG. 10 adapted for use with the frame means of FIG. 9.
Figure 13:
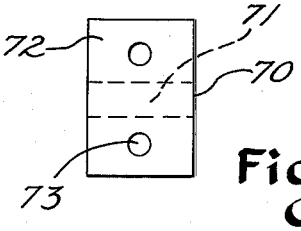
FIG. 13 is a top plan view of the connector member of FIG. 12.

Referring now particularly to FIGS. 7 and 8, each section 41 flares outwardly adjacent to the bottom thereof as indicated at 45 and has a bottom end wall 46 the edge of which terminates in the plane of the edges of the walls 44 and the ribs 43. The upper end portion of each said section has a small outward step as indicated at 47 surmounted by an upwardly tapering portion 48 whereby the outer wall surfaces converge inwardly toward the extension 25. The extreme upper end of each section is provided with a tongue or lip 49 which is disposed symmetrically with respect to the central rib 43 and is adapted to laterally overlap portions of both of the parallel extensions 25. The rib 43 of each said section is interrupted adjacent to the upper and lower ends thereof by breaks or cutouts 50 and 51, respectively, which lead into and are aligned with rectangular depressions 52 and 53 which extend transversely into both of the parallel, elongated recesses 42 as best seen in FIG. 7. The extensions 25 of the tubing T are connected together and held in an initial spaced relationship by means of connector members 56 as best seen in FIGS. 3 and 4. The connector members 56 extend transversely between the extensions 25 through the breaks or cutouts 50 in the ribs 43. Each connector member has a vertical length, as seen in FIGS. 4 and 6, substantially equal to the vertical dimension of the breaks or cutouts 50 and is provided in cross section with laterally oppositely directed, dovetail shaped portions 57 which slidably interfit the dovetail shaped groove 27 in the tubing T. Intermediate the dovetail shaped portions 57, each connector member is provided with a central transversely enlarged spacer portion 58, best seen in FIG. 3, which projects between the parallel handle extensions 25 and effectively maintains said extensions in uniform spaced relationship prior to application of the handgrip sections 41. When said handgrip sections are mounted upon the handle 23, the ribs 43 project inwardly between the extensions in the space provided by the spacer portions 58, the cutouts nest over the connector members 56, and said extensions are seated or nested within the elongated recesses 42. Said connector members may be made of any suitable material such as metal or plastic and may be pinned, riveted or bonded in place if desired.

The handgrip sections 41, the lower end portions of the extension 25, and the connector members 56 are preferably unitarily connected together by any suitable means, a preferred means comprising the use of an adhesive bonding compound such as an epoxy effectively bonding the parts together. A subsequent decorative and further unifying wrapping 59, shown only in FIG. 1, may also be applied.

The handgrip sections 41 may be made of any suitable, lightweight material. As herein illustrated, said sections are preferably made of a plastic such as a rigid polyurethane cellular material.

Figure 9:
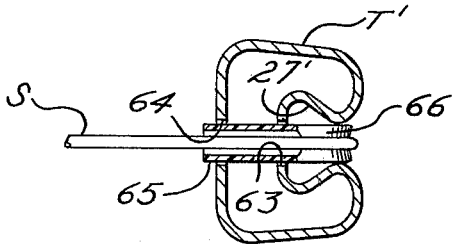
FIG. 9 is a cross section similar to FIG. 2 of a modified game racket frame and stringing means.
Figure 10:
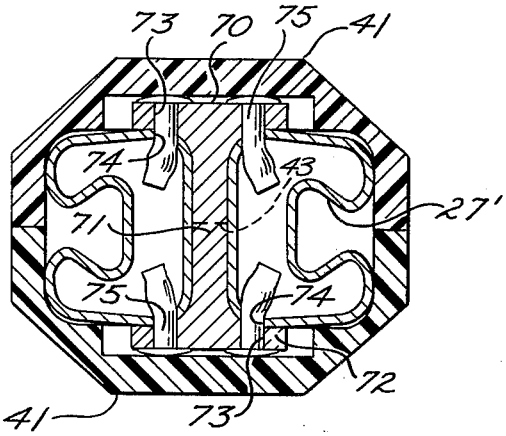
FIG. 10 is a view similar to FIG. 3 showing handgrip sections applied to the modified frame means of FIG. 9.

FIGS. 9-13 show a handgrip construction in which the handgrip sections 41 herein before described are applied to the lower end portions of extensions 25' of a handle 23' formed from a modified tubing T', the latter being best seen in FIGS. 9 and 10. The cross sectional configuration of the modified tubing T' is substantially identical with that of the first described tubing T with the exception that the dovetail shaped groove, indicated at 27' in FIG. 9, opens outwardly of the racket loop rather than inwardly thereof as in the first embodiment. This is indicated by the groove in FIG. 9 which faces oppositely with respect to the groove of FIG. 2, whereas the strings thereof project in the same direction as those shown in FIG. 2. The modified tubing T' is further provided with a plurality of spaced apertures 63 and 64 through the wall of the tubing at the bottom of the recess 27' and the inner periphery of the racket loop, respectively. Suitable string guide means are provided which include flexible, nonmetallic tube portions 65 projecting through aligned apertures 63 and 64 to protect the strings against the edges of said apertures, and rounded guide portions 66 disposed within said groove 27' and affording a nonabraiding means for lacing the string S in the racket loop.

As shown in FIG. 10, the lower end portions of the extension 25' are connected together and fixed in a predetermined spaced relationship by connector members 70 of H-shaped cross-section having a central web 71 and like flanges 72 disposed at either end of said web, said web being adapted to be disposed between said extensions and said flanges overlapping portions of said extension 25'. Aligned apertures 73 and 74 in the flanges 72 and the extension 25', respectively, provide means for receiving rivets 75 by means of which the lower end of said extensions are securely connected together.

In the last mentioned embodiment, the handgrip sections 41 are applied to the handle 23' in exactly the same way as described in the first embodiment with the ribs 43 projecting between the extensions 25', the edges of the side walls 44 and said ribs meeting in a medial plane of the assembled handgrip 40, as seen from the side thereof. The connector members 70 are disposed within the breaks or cutouts 50 of said ribs 43, and the flanges 72 are seated within the depressions 52 and 53. As in the first embodiment, the handgrip sections 41, the lower end portions of the extensions 25', and the connector members 70 are preferably further unitarily connected together to form a solid unit by means of a suitable connection means, preferably an adhesive bonding compound such as an epoxy.

It will be readily appreciated that although the second embodiment of FIGS. 9–13 shows a modified tubing T' having an outwardly opening groove, the same could be used with the tubing of the first embodiment, if desired, wherein the groove opens inwardly.

Thus, it will be seen that the present invention provides a handgrip which is readily adaptable for assembly with parallel frame extensions of different cross sectional shapes including those having a string mounting groove which opens either inwardly or outwardly of said extensions. The handgrip, in effect, becomes an integral part of the racket itself, is light weight enough not to effect the balance of the racket, and is highly strong and durable in use.

It will be understood that many changes in the details of the invention as herein described and illustrated may be made without, however, departing from the spirit of the invention or the scope of the appended claims.

We claim:

1. Handle structure for a game racket, said handle structure comprising a pair of parallel, laterally spaced extensions affording a handle for the racket, said extensions having laterally outwardly facing side edges and front and back surfaces disposed generally at right angles with respect to said side edges; connector means laterally connecting said extensions and maintaining said extensions in spaced relationship; a pair of complementary handgrip sections, each section having means providing spaced, parallel, elongated recesses disposed lengthwise of the section, and an elongated central rib projecting between said extensions; said sections being disposed over said front and back surfaces of said pair of extensions, distal end portions of said extensions nesting within said elongated recesses; means defining cutout means in said rib; said connector means projecting laterally through said cutout means; said extensions having dovetail shaped, longitudinal groove means opening inwardly toward each other; said connector means having oppositely disposed dovetail shaped portions interfitting said longitudinal groove means; said connector means having enlarged spacer means disposed between said dovetail shaped portions outwardly of said groove means for maintaining a fixed spacing between said extensions.

2. Handle structure for a game racket, said handle structure comprising a pair of parallel, laterally spaced extensions affording a handle for the racket, said extensions having outwardly and inwardly facing side edges and laterally disposed surface portions including front and back surfaces; connector means comprising a spacer portion disposed between said inwardly facing side edges of said extensions for maintaining said extensions in spaced relationship; said spacer portion having protrusions projecting therefrom in opposite directions; said extensions having groove means formed in said inwardly facing side edges for receiving said protrusions; said groove means having a bottom portion of greater dimension in transverse section than the opening thereof at said inwardly facing side edges; said protrusions being of greater dimension at their outermost ends than portions spaced inwardly of said outermost ends as seen in transverse section whereby said protrusions engage and interlock with said groove means; a pair of complementary handgrip sections, each section having an elongated central rib projecting parallel with and between said extensions and portions overlapping said laterally disposed surface portions and providing a handgrip; said ribs having cutout means therein and said connector means projecting laterally through said cutout means; and said spacer portion projecting perpendicular to the plane of said extensions beyond the opening of said groove means at said inwardly facing side edges and spacing said extensions from each other.

3. Handle structure for a game racket, said handle structure comprising a pair of laterally spaced extensions affording a handle, said extensions having laterally outwardly and inwardly facing side surfaces and front and back surfaces; connector means laterally connecting said extensions and maintaining said extensions in spaced relationship; a pair of complementary handgrip sections, each section having means providing spaced, parallel, elongated recesses disposed lengthwise of the section and an elongated central rib projecting between said extensions; said sections being disposed over said front and back surfaces of said pair of extensions, distal end portions of said extensions nesting within said elongated recesses; means defining cutout means in said rib; said connector means projecting laterally through said cutout means; said extensions having longitudinal groove means, said groove means having relatively narrow neck openings at said inwardly facing cide surfaces and being widened with respect to said neck openings toward the bottom of said groove means; said connector means having protuberances projecting into and engaging said grooves and connecting said extensions together; said connector means having a central spacer portion disposed between said extensions and projecting perpendicular to the plane of said extensions substantially beyond said neck openings and spacing said extensions from each other.

* * * * *